United States Patent [19]

Hirohata

[11] Patent Number: 4,584,794

[45] Date of Patent: Apr. 29, 1986

[54] GRINDER

[76] Inventor: Nobuyuki Hirohata, 180-8, Arimoto, Wakayama-shi, Wakayama-ken, Japan

[21] Appl. No.: 606,962

[22] Filed: May 4, 1984

[30] Foreign Application Priority Data

Jun. 2, 1983 [JP] Japan ..... 58-84719[U]

[51] Int. Cl.[4] ..... B24B 5/04

[52] U.S. Cl. ..... 51/56 R; 51/166 T; 51/3; 51/326

[58] Field of Search ..... 51/3, 4, 50 R, 51, 54, 51/55, 56 R, 122, 123 R, 166 T, 326, 327

[56] References Cited

U.S. PATENT DOCUMENTS

| | | | |
|---|---|---|---|
| 487,160 | 11/1892 | Rivett | 51/166 T |
| 1,294,024 | 2/1919 | Arter | 51/56 R |
| 2,437,850 | 3/1948 | Dennis | 51/166 T |
| 2,748,540 | 6/1956 | St. George | 51/166 T X |
| 3,006,116 | 10/1961 | Knost | 51/55 |
| 4,136,489 | 1/1979 | von Allmen | 51/166 T X |
| 4,306,382 | 12/1981 | Ueda | 51/56 R |
| 4,331,452 | 5/1982 | Causey et al. | 51/56 R X |

*Primary Examiner*—Robert P. Olszewski

*Attorney, Agent, or Firm*—Wenderoth, Lind & Ponack

[57] ABSTRACT

A grinder performs operations ranging from rough grinding to mirror-like finishing of the whole of an elongate peripheral surface of a work rotated around the central longitudinal axis thereof by pressing a grindstone to the work and by shifting the grindstone along the longitudinal direction of the central rotary axis of the work. By providing a rotor on the carriage adapted to move in parallel with the longitudinal axis of the work to be ground and by fixing grindstones different from each other in grain size to a plurality of rotating shafts fixed to the rotor, respectively, a grindstone in desired grain size is, upon rotation of the rotor, selectively brought into contact with the work. The grindstone that has been in contact with the work is rotated by a drive and, at the same time, the pressing force to act upon the work is imparted to the grindstone by a presser. Thus, the work is ground throughout the elongate peripheral surface thereof with the grindstone being pressed thereagainst by the presser and being shifted therealong by the drive.

1 Claim, 5 Drawing Figures

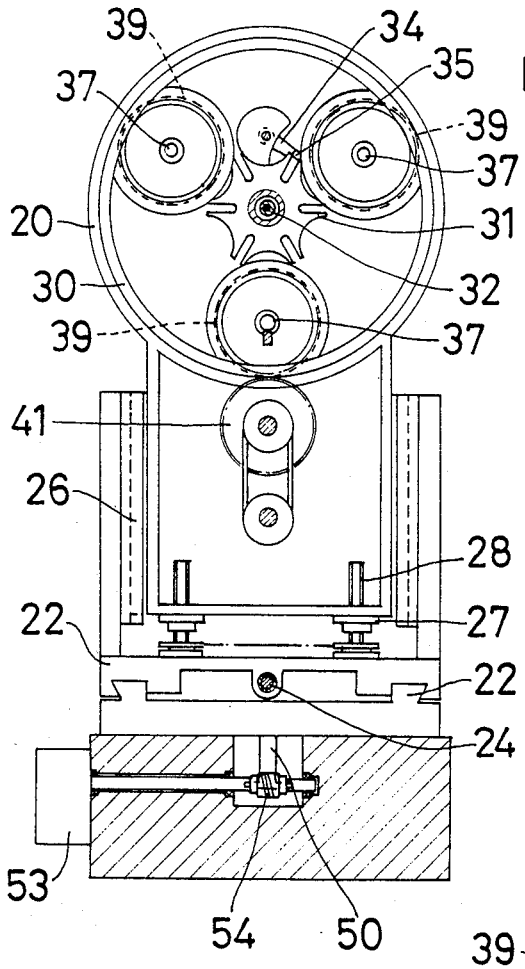
FIG. 3
FIG. 4
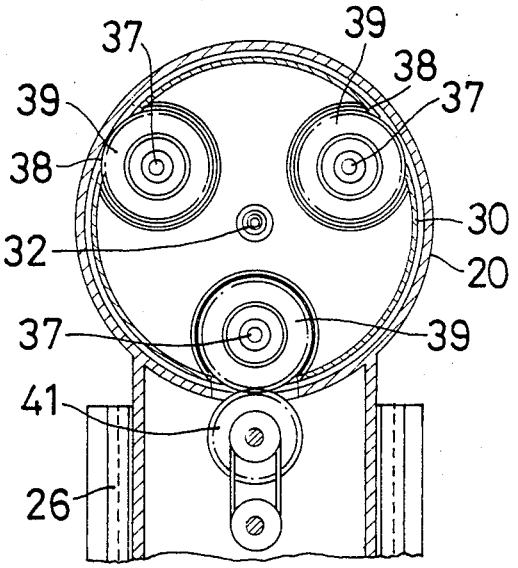

GRINDER

BACKGROUND OF THE INVENTION

1. Field of the Invention

The present invention relates to a grinder capable of performing the operations ranging from rough grinding to mirror-like finishing of the elongate peripheral surface of a work rotated around the central longitudinal axis thereof.

2. Description of the Prior Art

For attaining a mirror-like finish of the outer periphery of a work in the form of a round shaft, for example, a roller, round column, cone, or cylinder, the work must be ground in turn by grindstones in a plurality different from each other in grain size and adaptable to processes ranging from rough grinding to mirror-like finishing.

Mirror-like finishing of the work as described above is carried out in such steps that a rotating grindstone is brought into contact with the peripheral surface of a work to be ground and the grindstone is shifted along the longitudinal direction of the central axis of the work while contact as described above is maintained, such steps being preferable with respect to efficiency and accuracy.

Conventional type grinders employing a grinding method as described above have a structure in which a revolving shaft, having a grindstone fixed to the tip of the swing arm thereof to swing around a fulcrum, is supported by bearings to be exerted by the grindstone on the work is determined by a sliding weight to be stopped at a fixed position on the tip portion of the swing arm so that the grinding operation capable of following the oscillation or eccentricity of the work may be possible.

However, since grindstones adaptable to operations ranging from rough grinding to mirror-like finishing are different from each other in grain size, the following procedures are required for replacement thereof: first, releasing contact thereof with the work, stopping the grinder, pushing up the tip of the swing arm, removing the grindstone from the rotating shaft, fixing another grindstone to the rotating shaft, driving the grinder again, and determining a degree of pressing force of the grindstone against the work.

Consequently, a long period of time and many hands are required for replacement of grindstones, also, the grinder is inevitably stopped during this period, thereby causing low operation efficiency and high operation cost.

Particularly, a series of operations ranging from rough grinding to mirror-like finishing require more than three kinds of grindstones and, therefore, replacement of grindstones is a cause of low operation efficiency.

SUMMARY AND OBJECTS OF THE INVENTION

Accordingly, a first object of the present invention is to provide a grinder capable of reducing the length of time during which operations are suspended for replacement of grindstones and also capable of improving efficiency in mirror-like finishing.

A second object of the present invention is to provide a grinder excellent in accuracy in mirror-like finishing.

A third object of the present invention is to provide a grinder permitting unlimited adjustment of a contact position of the grindstone with the work and being capable of raising accuracy in finishing.

The above and other objects as well as advantages of the present invention will be understood more with reference to the appended drawings showing an example embodying the present invention and the following description.

BRIEF DESCRIPTION OF THE DRAWINGS

FIG. 3 is a sectional rear view of the driving part of a rotor thereof;

FIG. 4 is a vertical sectional rear view of the driving mechanism of the rotating shaft of the grindstone; and, FIG. 5 is a partially cutaway side view of a part pressing the grindstone.

DESCRIPTION OF THE PREFERRED EMBODIMENT

Figure 1:
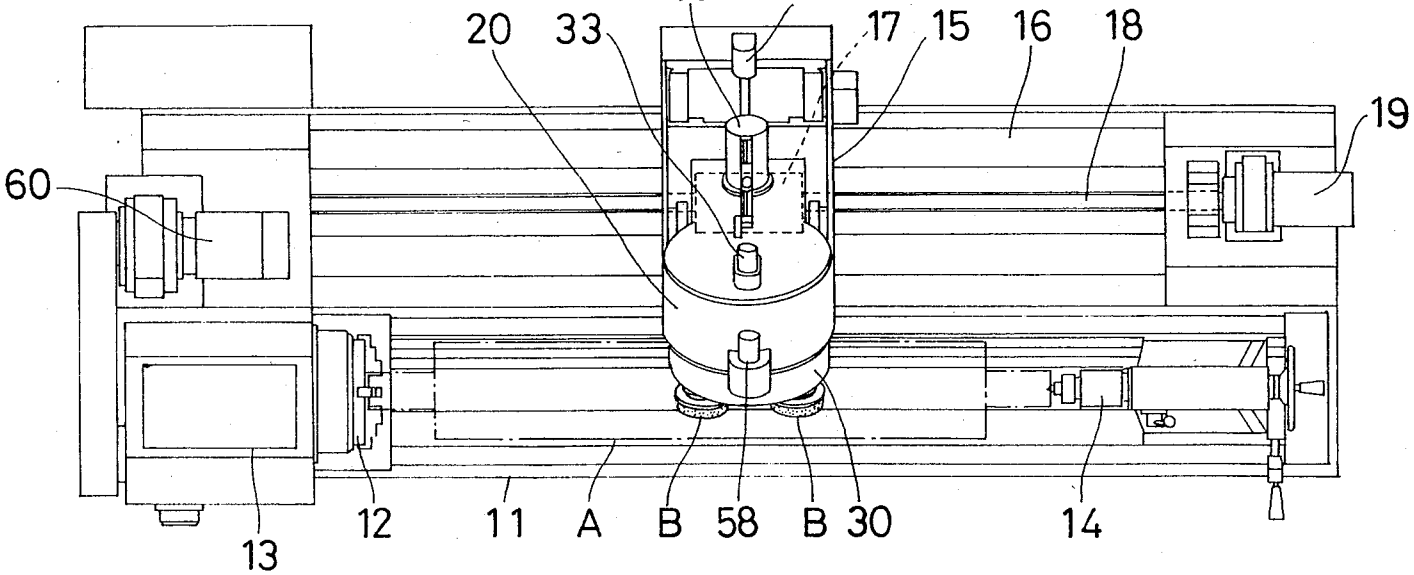
FIG. 1 is a plan view of a grinder according to this invention.

As shown in FIG. 1, a pair of supporting members comprising a head stock 13 provided with a revolving chuck 12 for supporting and rotating one end of a work A to be ground and a tail stock 14 for rotatably supporting the other end of the work A are provided on both ends of a bed 11, respectively, for supporting the work A rotatably around the central longitudinal axis thereof.

On the bed 11, there is a carriage 15 to move back and forth in parallel with the longitudinal axis of the work A.

The carriage 15 is guided by a rail 16 and has a slide surface so as to be slid back and forth on the externally threaded screw 18 which is screwed into the internally threaded screw 17 inside the carriage 15, also, the screw 18 be reversibly turned by a motor 19.

On the carriage 15, further, a bearing 20 is adjustable in a back-and-forth movement and also in an up-and-down movement relative to the outer periphery of the work A.

Figure 2:
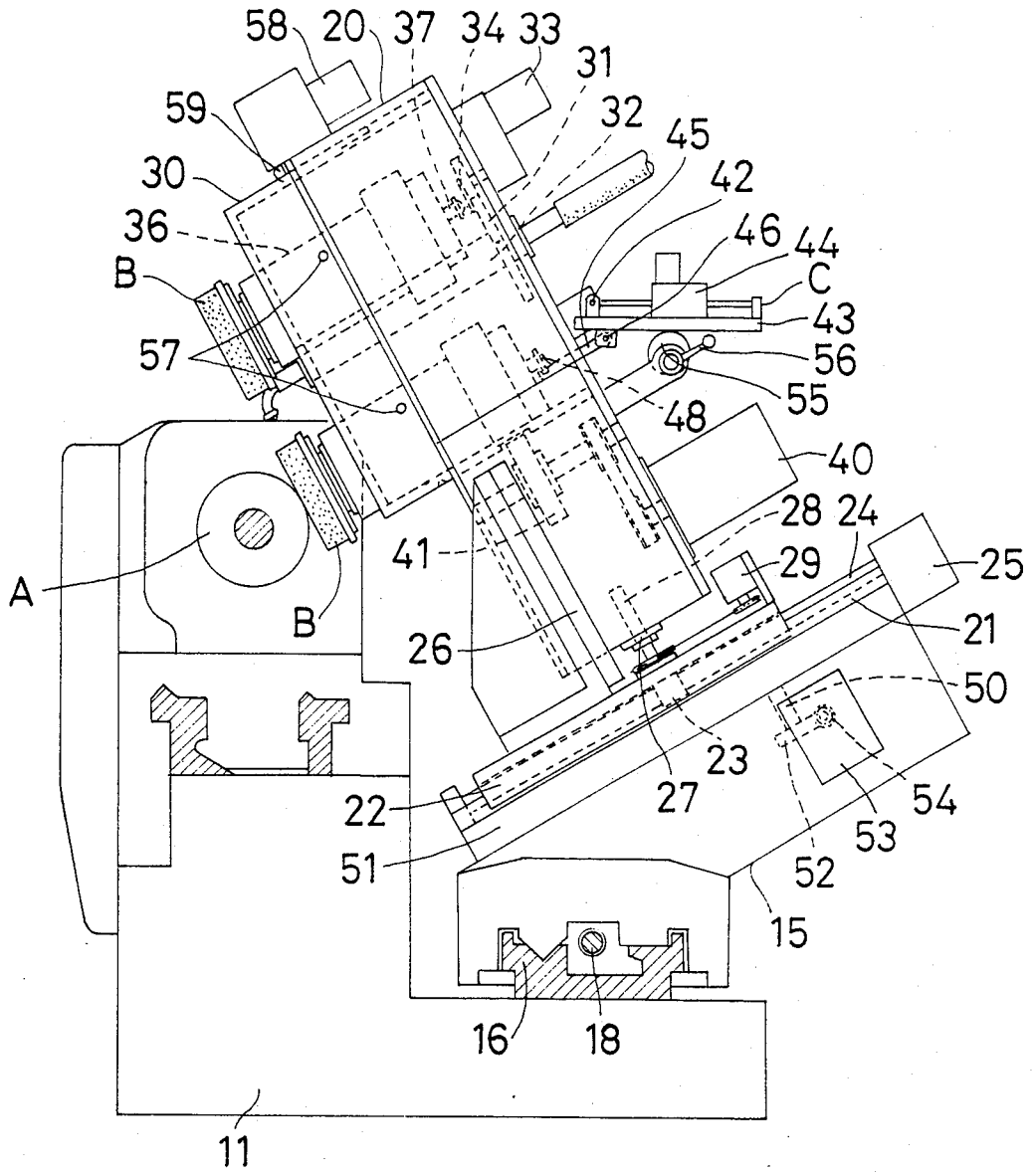
FIG. 2 is a partially cutaway enlarged side view thereof.

In the structure for adjustment of the back-and-forth and up-and-down movements, as shown in FIG. 2 and FIG. 3, a rail 21 having a slide surface is provided between front and rear ends of the carriage 15 on which a slider 22 to be guided by the rail 21 is mounted, the slider 22 is slid along an externally threaded screw 24 screwed into an internally threaded screw 23 secured inside the slider 22. The screw 24 may be reversibly turned by a motor 25, whereby the bearing 20 approaches the work A or recedes therefrom.

A guide rail 26 leaning forward against the work A is stood on the slider 22 for guiding the bearing 20 movably in the direction perpendicular to the slider 22. Internally threaded screws 27, into which externally threaded screws 28 freely rotatable at fixed positions on the slider 22 are screwed, are fixed to the bearing 20, whereby externally threaded screws 28 are reversibly driven by a motor 29 so as to move the bearing 20 perpendicularly to the slider 22.

A rotor 30 whose axis of rotation intersects the longitudinal axis of the work A at right angles is bearingly supported by the bearing 20.

The rotor 30, as shown in FIG. 3, is composed of a cylindrical body having a front wall and rotatably fitted into the cylindrical bearing 20.

The rotor 30, further, is adapted to perform intermittent rotation at fixed angular intervals.

In the example shown in FIG. 3, the said intermittent rotation depends on a shaft 32 carrying a follower wheel 31 aligned coaxially therewith, the follower wheel 31 is a Maltese cross turned by 120° by a pin 35 provided on the driving wheel 34 fitted onto a motor 33 (FIG. 2) supported by the bearing 20. The intermittent rotation, however, may depend on other methods.

Bearings 36 are shown in FIG. 2 on the inner peripheral part of the rotor 30 at the same intervals as the angular intervals of the intermittent rotation of the rotor 30.

A rotating shaft 37 is bearingly supported by each of the bearings 36 in such a manner as to permit sliding through the bearing 36, and, on the distal ends of rotating shafts 37, grindstones B different from each other in grain size and adaptable to the operations ranging from rough grinding to finish grinding are detachably fitted, respectively.

The rotating shaft 37 is driven upon contact of the grindstone B with the work A.

A method of driving the rotating shaft 37 is such that, as shown in FIG. 2 and FIG. 4, open windows 38 are provided in positions closest to the rotating shafts 37 on the peripheral wall of the rotor 30 for permitting parts of the outer peripheries of toothed gears 39 to enter these open windows 38. The toothed gears 39 are fixed to the rotating shafts 37, whereby a toothed gear 41 driven by a motor 40 (FIG. 2) supported by the bearing 20 is adapted to mesh with the toothed gears 39.

When the grindstone B is brought into contact with the work A, as shown in FIG. 2, the rotating shaft 37 is forwardly pressed by pressing means C which are capable of determining the pressing force as required without restriction.

Figure 5:
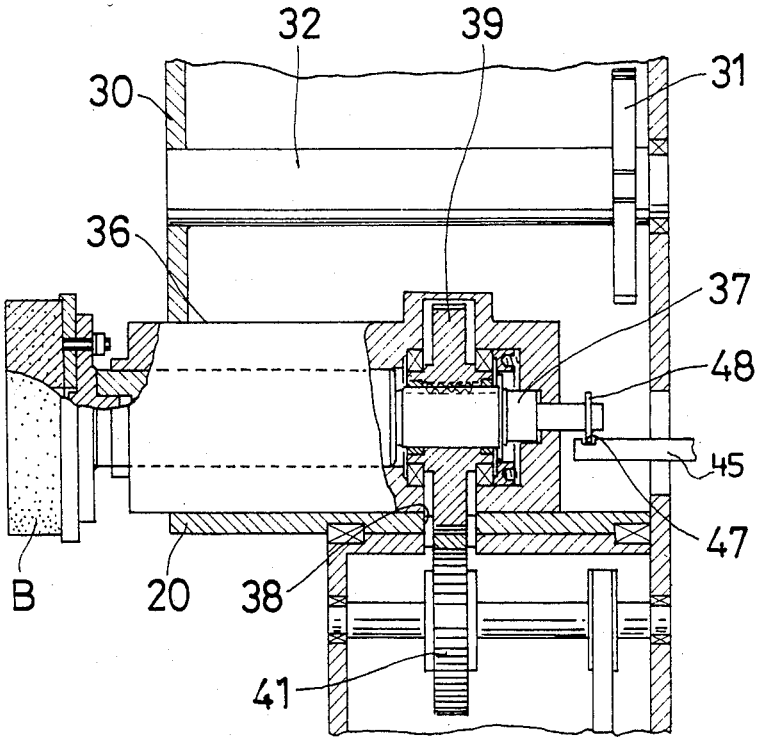

In the pressing means C, as shown in FIG. 2 and FIG. 5, the front end of a seat plate 43 is rotatably bearingly supported by the bearing 20 through a pin 42. A weight 44 adjustable in back-and-forth movement is provided on this seat plate 43. The distal end of a rod 45 lying in parallel with the rotating shaft 37 is connected to the underside tip of the seat plate 43 with a pin 46. A flange 48 provided on the distal end of the rotating shaft 37 enters a groove 47 provided on the upper front end of the rod 45 for connecting the rod 45 with the rotating shaft 37. Thereby the rotating shaft 37 is axially pressed by the weight 44.

Instead of the weight 44 pressing against the end of the rotating shaft 37, the slider 22 may be used for pressing the grindstone B to the work A.

As shown in FIG. 2, a turning plate 51 centering at a pin 50 is provided on the carriage 15. The slider 22 is mounted on this turning plate 51 while a worm wheel 52 fitted on the pin 50 is meshed with a worm 54 driven by a motor 53 for enabling slight turning of the bearing 20, whereby an angle of contact of the grindstone B with the work A can freely be adjusted.

In FIG. 2, a cam 55 has a lever 56 and is used for pushing upward the seat plate 43 by turning thereof, thereby releasing the pressing of the weight 44 against the rotating shaft 37.

In the example shown in FIGS. 3 and 4, grindstones are arranged in three positions on the front side of the rotor 30. However, arrangement thereof is not limited to this example and may be in such manner that, for instance, a rotor 30 is secured to the bearing so as to be rotatable around an axis parallel with the work A. The grindstones are fixed to the outer periphery of this rotor 30 at fixed intervals or a rotor 30 is shaped in the form of a frame coaxial with A the work, and grindstones B are fixed to this rotor 30 so as to surround the work A.

A method according to the present invention using a grinder will be described.

First, referring to FIG. 1, the work A is held by the revolving chuck 12 and the tail stock 14.

As shown in FIG. 2, the follower wheel 31 is rotated by a drive of the motor 33 through a pin 35 (FIG. 3) of the driving wheel 34, the rotor 30 is adapted to perform intermittent rotation. On the other hand, while a grindstone B for rough grinding is adapted to confront the work A, the tip of a pin 59 projected by a drive of the motor 58 is inserted into a recess 57 provided on the outer periphery of the rotor 30 for engagement therewith so that a stop position of the rotor 30 is determined and inadvertent commencement of rotation of the rotor 30 is prevented.

At this time, as shown in FIG. 5, a gear 39 of the rotating shaft 37 carrying the grindstone B facing the work A meshes with the toothed gear 41.

Then, as shown in FIG. 5, while a flange 48 is inserted into the groove 47 and, as shown in FIG. 2, while the cam 55 is turned by the lever 56 for releasing the seat plate 43 from being pushed upward, and, while the rotating shaft 37 is projected along with the rod 45 by means of the weight 44 through the seat plate 43, the grindstone B is pressed to the work A.

As shown in FIG. 1, a motor 60 is actuated for rotating the work A. Another motor 19 is actuated for sliding the carriage 15 back and forth, and still another motor 40 is actuated, whereby the work A is ground by the grindstone B driven, as shown in FIG. 5, through the toothed gears 41 and 39 and the rotating shaft 37.

With the end of grinding by the grindstone B for rough grinding, the motors 19 and 40 in FIG. 1 are stopped, and, as shown in FIG. 2, the seat plate 43 is pushed upward with the cam 55 turned by the lever 56 for releasing the rotating shaft 37 from being pressed by the rod 45, then, the pin 59 is withdrawn, when the subsequent grindstone B is adapted to face the work A with each intermittent turn of the rotor 30.

In a sequence of the above steps, the work A is ground by a series of grindstones adapted to the operations ranging from rough grinding to finish grinding.

As described above, according to the present invention, a rotor 30 is provided on the carriage 15 to be shifted back and forth and intermittently is turned at a fixed degree of angle. The rotating shafts 37 are provided in spaced positions corresponding to the pitch of the intermittent angular turn of the rotor, 30 the grindstones B are different from each other in grain size and are adapted to the operations ranging from rough grinding to mirror-like finishing. These grindstones B are fixed to the distal ends of rotating shafts 37. Thus, the invention is free of necessity to stop the grinder for a long period of time for replacement of the grindstones B.

Therefore, the time required for a series of operations ranging from rough grinding to finish grinding of the work A can be shortened to raise operation efficiency.

The structure for pressing the grindstone B to the work A prevents the grindstone B from floating and ensures satisfactory grinding.

Further, the bearing 36 of the rotor 30 is adjustable in up-and-down and back-and-forth movements relative to the carriage 15 and, accordingly, a contact position of the grindstone B with the work A is adjustable without limitation.

What is claimed is:

1. An apparatus for grinding a workpiece, comprising:

means for supporting opposite ends of the workpiece to be ground;

means, mounted on the supporting means, for rotating the workpiece around a central longitudinal axis therethrough;

a carriage being disposed between the supporting means and being shiftable parallel to the central longitudinal axis through the workpiece;

a rotor means, provided on the carriage, for carrying a plurality of grindstones thereon;

each of said plurality of grindstones being different from each other in grain size;

each of said plurality of grindstones being adaptable to operations ranging from rough grinding to mirror-like finishing;

a bearing means, arranged on the carriage, for operatively connecting the rotor means with the carriage;

a plurality of shaft means, extending between the rotor means and the bearing means along a line perpendicular to the central longitudinal axis of the workpiece, for rotating the plurality of grindstones;

first rail means, arranged on the carriage along a line parallel to but spaced from the line along which the plurality of shaft means are extending, for guiding the bearing means back and forth therealong;

first motor means, arranged on the carriage, for sliding the bearing means back and forth along the first rail means;

second rail means, arranged on the carriage perpendicular to the first rail means, for guiding the bearing means up and down therealong;

second motor means, arranged on the carriage, for sliding the bearing means up and down along the second rail means;

means, arranged on the bearing means, for pressing against one end of a selected one of the plurality of shaft means so that a selected one of the plurality of grindstones on an opposite end of the selected one of the plurality of shaft means comes into contact with the workpiece;

wherein said pressing means includes a seat plate having a top surface and a bottom surface;

a weight slidable along the top surface of the seat plate;

a cam rollable along the bottom surface of the seat plate;

a lever means, connected to the cam, for turning the cam into and out of engagement with the seat plate; and a pin means, connected at one end to the seat plate, for engaging at an opposite end with the one end of the selected one of the plurality of shaft means;

whereby movement of the lever means causes the cam to move out of engagement with the seat plate, allowing the seat plate to move and the weight to slide on the seat plate so as to create a force through the pin means pressing the selected one of the plurality of grindstones into contact with the workpiece.

* * * * *